US010941741B2

(12) United States Patent
Yagai et al.

(10) Patent No.: US 10,941,741 B2
(45) Date of Patent: Mar. 9, 2021

(54) HIGH-PRESSURE FUEL SUPPLY PUMP

(71) Applicant: Hitachi Automotive Systems, Ltd., Hitachinaka (JP)

(72) Inventors: Masamichi Yagai, Hitachinaka (JP); Atsushi Hohkita, Hitachinaka (JP); Hiroyuki Yamada, Hitachinaka (JP); Masayuki Suganami, Hitachinaka (JP); Satoshi Usui, Hitachinaka (JP); Atsuji Saito, Hitachinaka (JP); Kenichirou Tokuo, Hitachinaka (JP); Yuta Saso, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 109 days.

(21) Appl. No.: 15/304,237

(22) PCT Filed: Apr. 17, 2015

(86) PCT No.: PCT/JP2015/061776
§ 371 (c)(1),
(2) Date: Oct. 14, 2016

(87) PCT Pub. No.: WO2015/163245
PCT Pub. Date: Oct. 29, 2015

(65) Prior Publication Data

US 2017/0037822 A1 Feb. 9, 2017

(30) Foreign Application Priority Data

Apr. 25, 2014 (JP) ..... JP2014-090822

(51) Int. Cl.
*F04B 53/10* (2006.01)
*F02M 59/46* (2006.01)
(Continued)

(52) U.S. Cl.
CPC ..... *F02M 59/462* (2013.01); *F02M 59/34* (2013.01); *F02M 59/44* (2013.01);
(Continued)

(58) Field of Classification Search
CPC ..... F04B 53/10; F04B 49/08; F04B 9/042; F04B 7/0266; F04B 53/06
See application file for complete search history.

(56) References Cited

U.S. PATENT DOCUMENTS 4,467,767 A 8/1984 Kampichler et al.
4,561,828 A * 12/1985 Wolff ..... F04B 53/1032 251/83
(Continued)

FOREIGN PATENT DOCUMENTS

DE 10 2007 000 293 A1 11/2007
EP 1 770 274 A1 4/2007
(Continued)

OTHER PUBLICATIONS

Extended European Search Report issued in counterpart European Application No. 15783842.6 dated Nov. 30, 2017 (Six (6) pages).
(Continued)

*Primary Examiner* — Charles G Freay
*Assistant Examiner* — Thomas Fink
(74) *Attorney, Agent, or Firm* — Crowell & Moring LLP

(57) ABSTRACT

To increase a valve-opening pressure at which a pressure relief valve is opened in order to deal with a higher pressure of the fuel, a large pressure relief valve is installed in a high-pressure fuel supply pump. This upsizes the high-pressure fuel supply pump. A pressure relief valve is installed in a discharge joint. This can provide a high-pressure fuel supply pump that is not large too much and
(Continued)

sufficiently performs a relief function by efficiently using the excessive space in the pump even when the fuel pressure is increased.

14 Claims, 8 Drawing Sheets

(51) Int. Cl.

| | |
|---|---|
| ***F02M 59/34*** | (2006.01) |
| ***F02M 59/44*** | (2006.01) |
| ***F02M 59/48*** | (2006.01) |
| ***F02M 63/00*** | (2006.01) |
| ***F04B 19/22*** | (2006.01) |

(52) U.S. Cl.
CPC ..... *F02M 59/46* (2013.01); *F02M 59/485* (2013.01); *F02M 63/005* (2013.01); *F04B 19/22* (2013.01)

(56) References Cited

U.S. PATENT DOCUMENTS

| | | | | |
|---|---|---|---|---|
| 2007/0110603 | A1* | 5/2007 | Usui | F02M 63/005 417/505 |
| 2007/0286742 | A1 | 12/2007 | Inoue | |
| 2010/0242922 | A1* | 9/2010 | Mancini | F02M 59/462 123/506 |
| 2011/0103985 | A1 | 5/2011 | Mancini et al. | |
| 2011/0126804 | A1* | 6/2011 | Lucas | F02M 59/366 123/456 |
| 2012/0227711 | A1 | 9/2012 | Saito | |
| 2012/0251365 | A1* | 10/2012 | Ono | F02M 63/0077 417/440 |
| 2012/0251366 | A1 | 10/2012 | Kuroyanagi et al. | |
| 2014/0255219 | A1* | 9/2014 | Lucas | F04B 1/0452 417/282 |
| 2014/0305410 | A1* | 10/2014 | Lucas | F02M 59/367 123/456 |
| 2014/0314605 | A1* | 10/2014 | Koga | F02M 37/0023 417/568 |

FOREIGN PATENT DOCUMENTS

| | | | |
|---|---|---|---|
| EP | 1 788 231 | A1 | 5/2007 |
| JP | 56-41157 | U | 4/1981 |
| JP | 3-41089 | Y2 | 8/1991 |
| JP | 11-6475 | A | 1/1999 |
| JP | 2004-218547 | A | 8/2004 |
| JP | 2008-64013 | A | 3/2008 |
| JP | 2009-103008 | A | 5/2009 |
| JP | 2009-257197 | A | 11/2009 |
| JP | 2010-19263 | A | 1/2010 |
| JP | 2010-169083 | A | 8/2010 |
| JP | 2012-229668 | A | 11/2012 |
| JP | 2013-167259 | A | 8/2013 |
| KR | 10-2012-0018395 | A | 3/2012 |
| KR | 10-1182131 | B1 | 9/2012 |

OTHER PUBLICATIONS

Japanese-language Office Action issued in counterpart Japanese Application No. 2016-514898 dated Sep. 5, 2017 with English translation (Five (5) pages).

International Search Report (PCT/ISA/210) issued in PCT Application No. PCT/JP2015/061776 dated Jul. 21, 2015, with English translation (two (2) pages).

Japanese-language Office Action issued in counterpart Japanese Application No. 2016-514898 dated Oct. 2, 2018 with English translation (five (5) pages).

Japanese-language Office Action issued in counterpart Japanese Application No. 2019-005751 dated Dec. 3, 2019 with English translation (eight (8) pages).

Extended European Search Report issued in counterpart European Application No. 19186498.2 dated Nov. 19, 2019 (eight (8) pages).

Japanese-language Office Action issued in Japanese Application No. 2019-005751 dated Jul. 7, 2020 with English translation (seven (7) pages).

* cited by examiner

HIGH-PRESSURE FUEL SUPPLY PUMP

TECHNICAL FIELD

The present invention relates to the configuration of a high-pressure fuel supply pump for an internal-combustion engine of a vehicle.

BACKGROUND ART

High-pressure fuel supply pumps that increase the pressure of the fuel are widely used for direct-injection internal-combustion engines in which the fuel is directly injected to the inside of the combustion chamber among internal-combustion engines, for example, of vehicles.

The high-pressure fuel supply pump is sometimes provided with a pressure relief valve mechanism that opens when an excessive high pressure is generated in a high-pressure pipe in the downstream part of the discharge valve so as to communicate the downstream high-pressure fuel path of the discharge valve with the upstream low-pressure fuel path of the discharge valve and protect the high-pressure pipes including a common rail.

JP 2009-257197 A describes a high-pressure fuel supply pump in which a pressure relief valve mechanism is integrally and vertically or horizontally provided to the pump body (see PTL 1).

JP 2013-167259 A is another Patent Literature.

CITATION LIST

Patent Literature

PTL 1: JP 2009-257197 A
PTL 2: JP 2013-167259 A

SUMMARY OF INVENTION

Technical Problem

Recently, in order to deal with environmental regulations, there is the increasing demand for increasing the pressure of the fuel in a direct-injection internal-combustion engine in which the fuel is directly injected to the inside of the combustion chamber among internal-combustion engines, for example, of vehicles. In order to deal with a higher pressure of the fuel, it is necessary to increase the valve-opening pressure to open the pressure relief valve. In order to increase the valve-opening pressure, it is necessary to strengthen the relief biasing string. As a result, the size of the pressure relief valve is adversely increased. Thus, in conventional techniques, the size of the high-pressure fuel supply pump is increased so that such an upsized pressure relief valve is installed in the high-pressure fuel supply pump. For example, in PTL 2, the pressure relief valve mechanism is not provided to the protruding joint, and the discharge valve is integrated with the pressure relief valve mechanism. This makes it difficult to strengthen the relief biasing string.

Additionally, such an upsized high-pressure fuel supply pump makes it difficult to leave space for installing the high-pressure fuel supply pump depending on engines, or makes the layout of the high-pressure pipes complicated and increases the cost.

An objective of the present invention is to provide a high-pressure fuel supply pump in which the pressure relief valve can be installed in the pump body with a simple structure and the pump body can be reduced in size even when the high-pressure fuel supply pump deals with a high fuel pressure.

Solution to Problem

Installing the pressure relief valve in the discharge joint can achieve the objective of the present invention.

Advantageous Effects of Invention

According to the present invention having the configuration described above, a high-pressure fuel supply pump that is not large too much and sufficiently performs a relief function by efficiently using the excessive space in the pump even when the high-pressure fuel supply pump deals with a higher fuel pressure.

DESCRIPTION OF EMBODIMENTS

Figure 1:
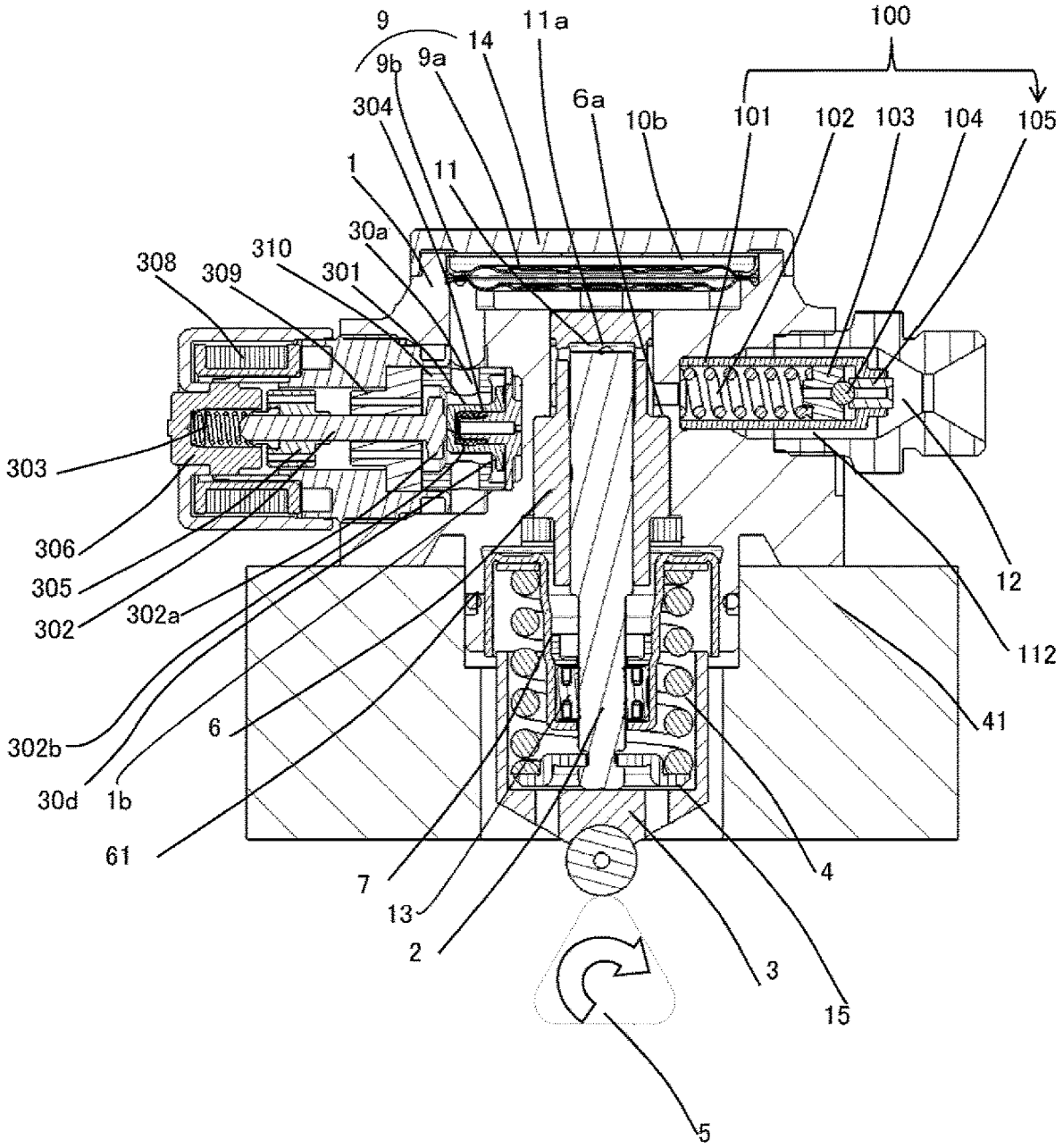
FIG. 1 is a vertical cross-sectional view of the whole of a high-pressure fuel supply pump according to a first embodiment of the present invention.

Hereinafter, an embodiment according to the present invention will be described.

First Embodiment

The configuration and operation of a system will be described with reference to the view of the whole configuration of the system illustrated in FIG. 4.

A part surrounded by a dashed line is the body of a high-pressure fuel supply pump (hereinafter, referred to as a high-pressure pump). The mechanism and parts in the dashed line are integrally embedded in a high-pressure pump body 1. The fuel in a fuel tank 20 is pumped up by a feed pump 21, and fed via an intake pipe 28 to an intake joint 10*a* of the pump body 1.

After passing through the intake joint 10*a*, the fuel passes through a pressure pulsation reducing mechanism 9, and an intake path 10*b*, and reaches an intake port 30*a* of an electromagnetic inlet valve 30 included in a flow rate control mechanism. The pulsation preventing mechanism 9 will be described below.

The electromagnetic inlet valve 30 includes an electromagnetic coil 308. When the electromagnetic coil 308 does not conduct electricity, the difference between the biasing force of an anchor spring 303 and the biasing force of a valve spring 304 biases an inlet valve body 301 in a valve-opening direction in which the inlet valve body 301 is opened, and this opens the intake opening 30*d*. Note that the biasing force of the anchor spring 303 and the biasing force of the valve spring 304 are set so that the biasing force of the anchor spring 303>the biasing force of the valve spring 304 holds.

Figure 4:
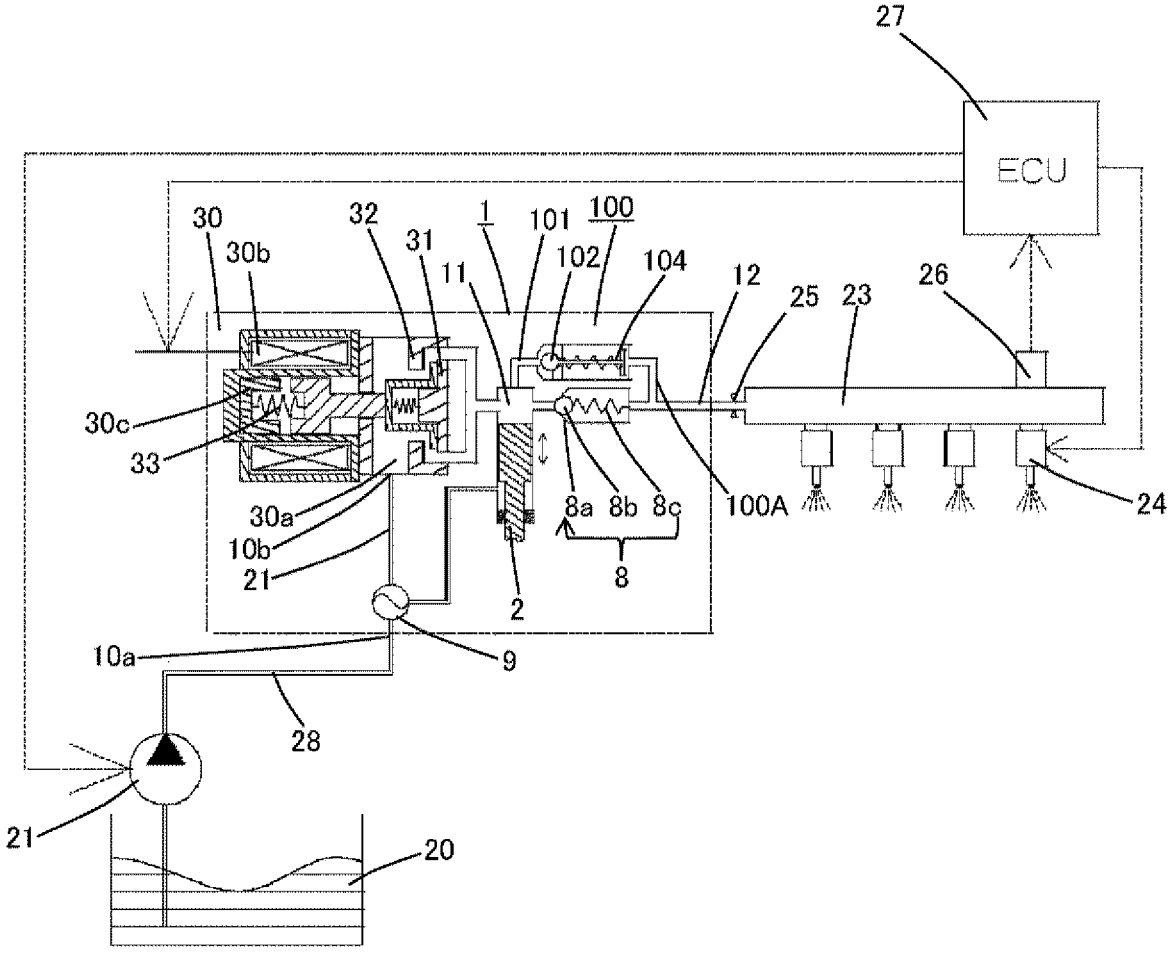
FIG. 4 illustrates an exemplary fuel supply system using the high-pressure fuel supply pump according to the first embodiment of the present invention.

When the electromagnetic coil 308 conducts electricity, a state in which an anchor 305 is moved to the left side of FIG. 4 and the anchor spring 303 is compressed is maintained. An inlet valve body 301 with which the tip of an electromagnetic plunger 305 coaxially has contact seals the intake opening 30*d* connected to a pressurizing chamber 11 of the high-pressure pump using the biasing force of the valve spring 304.

The operation of the high-pressure pump will be described hereinafter.

When the rotation of a cam described below displaces a plunger 2 downward in FIG. 1 and the plunger 2 is in an intake process, the volume of the pressurizing chamber 11 is increased and the fuel pressure in the pressurizing chamber 11 is decreased. In the intake process, when the fuel pressure in the pressurizing chamber 11 is reduced to a pressure lower than the pressure in the intake path 10*b* (the intake port 30*a*), the fuel passes through the opened intake opening 30*d* and flows into the pressurizing chamber 11. When the plunger 2 completes the intake process and moves to a compression process, the plunger 2 moves to the compression process (a state in which the plunger 2 moves upward in FIG. 1). At that time, a state in which the electromagnetic coil 308 does not conduct electricity is maintained, and thus magnetic biasing force does not act. Thus, the inlet valve body 301 is still opened by the biasing force of the anchor spring 303. The volume of the pressurizing chamber 11 decreases with the compressing motion of the plunger 2. In such a state, the fuel sucked in the pressurizing chamber 11 is returned through the opened inlet valve body 301 to the intake path 10*b* (the intake port 30*a*). Thus, the pressure in the pressurizing chamber is not increased. This process is referred to as a return process.

When a control signal from an engine control unit 27 (hereinafter, referred to as ECU) is applied to the electromagnetic inlet valve 30 in the return process, a current flows through the electromagnetic coil 308 of the electromagnetic inlet valve 30. The magnetic biasing force moves the electromagnetic plunger 305 to the left side of FIG. 4 and a state in which the anchor spring 303 is compressed is maintained. As a result, the biasing force of the anchor spring 303 does not act on the inlet valve body 301. The fluid force due to the biasing force of the valve spring 304 and the flow of the fuel into the intake path 10*b* (the intake port 30*a*) acts. This closes the inlet valve 301 and thus closes the intake opening 30*d*. When the intake opening 30*d* is closed, the fuel pressure in the pressurizing chamber 11 starts increasing with the upward motion of the plunger 2. When the fuel pressure is larger than or equal to the pressure in the discharge joint 12, the fuel remaining in the pressurizing chamber 11 is discharged at high pressure through the discharge valve mechanism 8, and fed to the common rail 23. This process is referred to as a discharge process.

In other words, the compression process of the plunger 2 (a process in which the plunger 2 rises from a lower starting point to an upper starting point) includes the return process and the discharge process. Controlling the timing at which the electromagnetic coil 308 of the electromagnetic inlet valve 30 conducts electricity can control the amount of the high-pressure fuel to be discharged. When the timing at which the electromagnetic coil 308 conducts electricity is hastened, the proportion of the return process is low and the proportion of the discharge process is high to the compression process. In other words, the amount of fuel to be returned to the intake path 10*b* (the intake port 30*a*) is decreased and the amount of fuel to be discharged at high pressure is increased. On the other hand, when the timing at which the electromagnetic coil 308 conducts electricity is delayed, the proportion of the return process is high and the proportion of the discharge process is low to the compression process. In other words, the amount of fuel to be returned to the intake path 10*b* is increased and the amount of fuel to be discharged at high pressure is decreased. The timing at which the electromagnetic coil 308 conducts electricity is controlled by the instructions from the ECU.

The configuration described above controls the timing at which the electromagnetic coil 308 conducts electricity. This can control the amount of fuel to be discharged at high pressure in accordance with the amount of fuel that the internal-combustion engine requires.

The outlet of the pressurizing chamber 11 is provided with a discharge valve mechanism 8. The discharge valve mechanism 8 includes a discharge valve seat 8*a*, a discharge valve 8*b*, and a discharge valve spring 8*c*. When there is no fuel differential pressure between the pressurizing chamber 11 and the discharge joint 12, the discharge valve 8*b* is pressed and fixed to the discharge valve seat 8*a* and closed by the biasing force of the discharge valve spring 8*c*. When the fuel pressure in the pressurizing chamber 11 exceeds the fuel pressure in the discharge joint 12, the discharge valve 8*b* is opened against the discharge valve spring 8*c* and the fuel in the pressurizing chamber 11 is discharged at high pressure through the discharge joint 12 to the common rail 23.

As described above, the fuel guided to the intake joint 10*a* is pressurized at high pressure by the reciprocation of the plunger 2 in the pressurizing chamber 11 of the pump body 1 as much as necessary, and fed from the discharge joint 12 to the common rail 23 by the pressure.

Injectors 24 for direct injection (namely, a direct-injection injectors) and a pressure sensor 26 are attached to the common rail 23. The number of the attached direct-injection injectors 24 corresponds to the number of cylinder engines of the internal-combustion engine. The direct-injection injectors 24 open and close in accordance with the control signal from the engine control unit (ECU) 27 so as to inject the fuel in the cylinder.

The pump body 1 is further provided with a discharge flow path 110 communicating the downstream part of the discharge valve 8*b* with the pressurizing chamber 11 and bypassing the discharge valve, separately from the discharge flow path. The discharge flow path 110 is provided with a pressure relief valve 104 that limits the flow of the fuel only to a direction from the discharge flow path to the pressurizing chamber 11. The pressure relief valve 104 is pressed to the pressure relief valve seat 105 by the relief spring 102 that generates pressing force. When the difference between the pressure in the pressurizing chamber and the pressure in a relief path is larger than or equal to a predetermined pressure, the pressure relief valve 104 moves away from the pressure relief valve seat 105 and opens.

For example, when a failure of the direct-injection injector 24 causes an excessive high pressure in the common rail 23 and the differential pressure between the discharge flow path 110 and the pressurizing chamber 11 is larger than or equal to the valve-opening pressure at which the pressure relief valve 104 is opened, the pressure relief valve 104 opens and the discharge flow path at the excessive high pressure is returned from the discharge flow path 110 to the pressurizing chamber 11. This protects a high-pressure pipe such as the common rail 23.

Figure 2:
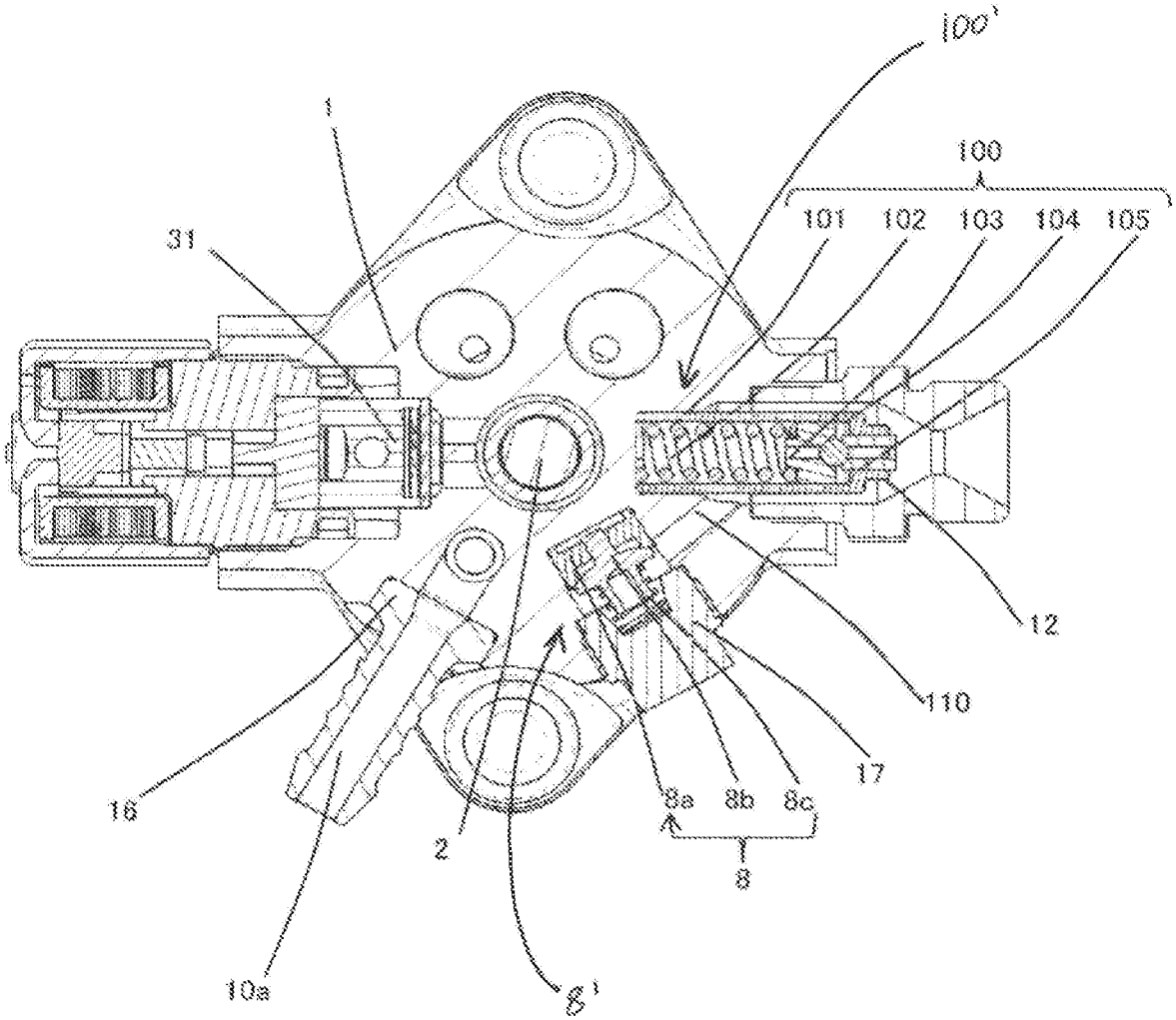
FIG. 2 is a horizontal cross-sectional view of the whole of the high-pressure fuel supply pump according to the first embodiment of the present invention.
Figure 3:
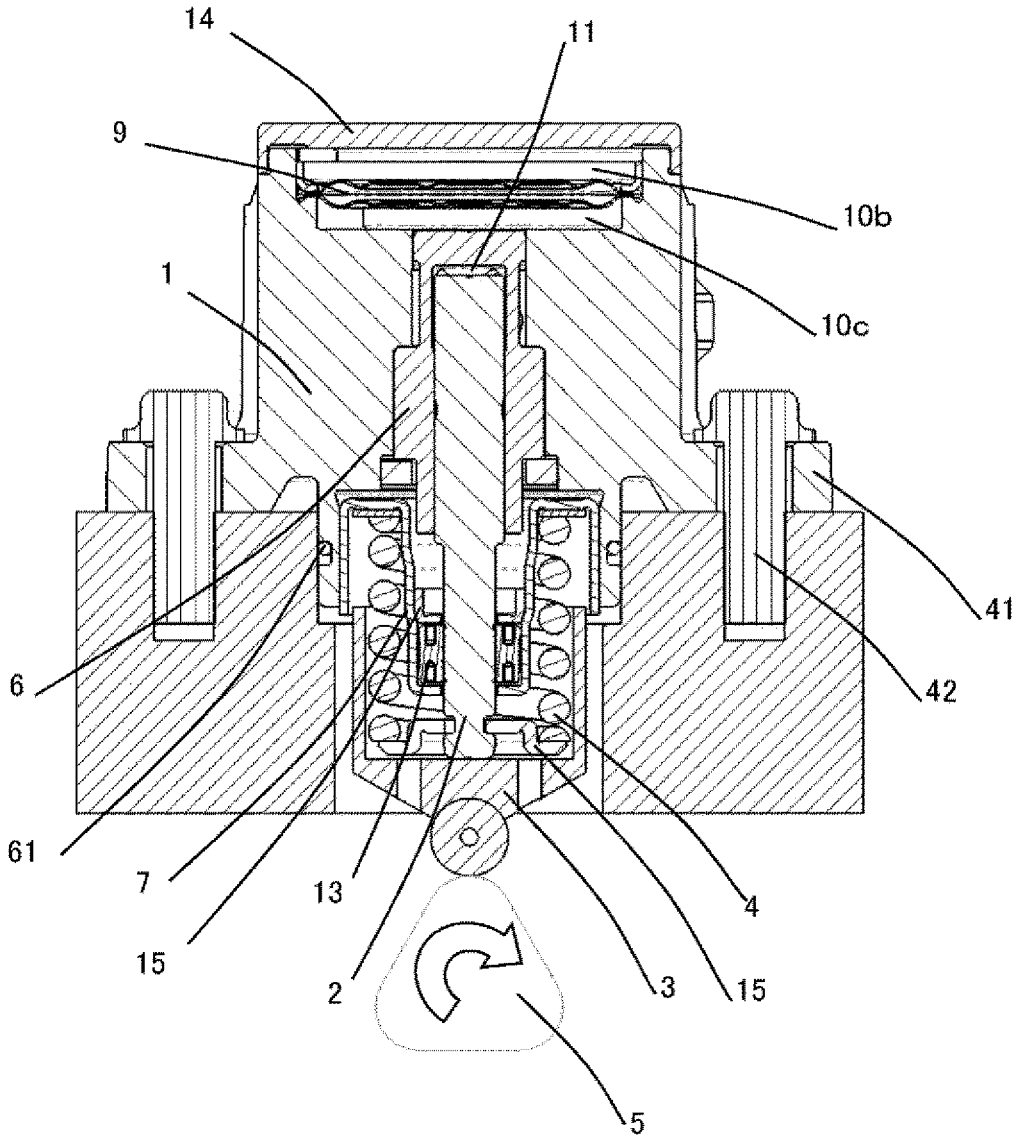
FIG. 3 is a vertical cross-sectional view of the whole of the high-pressure fuel supply pump according to the first embodiment of the present invention.

Hereinafter, the configuration and operation of the high-pressure fuel pump will be described in more detail with reference to FIGS. 1 to 4. A general high-pressure pump is air-tightly sealed and fixed to the flat surface of a cylinder head 41 of the internal-combustion engine with a flange 1*e* provided to the pump body 1. An O-ring 61 is fitted to the pump body 1 so that the airtightness between the cylinder head and the pump body is retained. As shown in FIG. 2, a a discharge valve mechanism 8 is placed in the first valve chest 8', and the pressure relief valve mechanism 100 placed in the second valve chest 100'.

A cylinder 6 is attached to the pump body 1. The cylinder 6 is formed in a cylinder with a bottom on an end so that the cylinder 6 guides the back-and-forth movement of the plunger 2 and the pressurizing chamber 11 is formed in the cylinder 6. The pressurizing chamber 11 is provided with a plurality of communication holes 11*a* so that the pressurizing chamber 11 communicates with the electromagnetic inlet valve 30 configured to feed the fuel and the discharge valve mechanism 8 configured to discharge the fuel from the pressurizing chamber 11 to the discharge path.

The outer diameter of the cylinder 6 includes a large-diameter part and a small-diameter part. The small-diameter part is pressed and inserted in the pump body 1. The surface of a width difference 6*a* between the large-diameter part and the small-diameter part is pressed and fixed to the pump body 1. This prevents the fuel pressurized in the pressurizing chamber 11 from leaking to the low-pressure side.

The lower end of the plunger 2 is provided with a tappet 3 that converts the rotation movement of a cam 5 attached to a camshaft of the internal-combustion engine into up-and-down movement, and transmits the up-and-down movement to the plunger 2. The plunger 2 is pressed and fixed to the tappet 3 through a retainer 15 with a spring 4. This can move (reciprocate) the plunger 2 up and down with the rotation movement of the cam 5.

A plunger seal 13 held on the lower end of the inner periphery of the seal holder 7 has slidably contact with the outer periphery of the plunger 2 on the lower end of the cylinder 6 in the drawing. This seals the blow-by gap between the plunger 2 and the cylinder 6 and prevents the fuel from leaking to the outside of the pump. Meanwhile, this prevents the lubricant (including engine oil) that smoothly moves a sliding part of the internal-combustion engine from leaking through the blow-by gap into the pump body 1.

The fuel sucked by the feed pump 21 is fed through the intake joint 10*a* coupled with the intake pipe 28 to the pump body 1.

A damper cover 14 is coupled with the pump body 1 and forms a low-pressure fuel chamber 10. The fuel passing through the inlet joint 10*a* flows into the low-pressure fuel chamber 10. In order to remove an obstacle such as a metal powder in the fuel, a fuel filter 102 is attached to the upstream part of the low-pressure fuel chamber 10, for example, while being pressed and inserted in the pump body 1.

A pressure pulsation reducing mechanism 9 is installed in the low-pressure fuel chamber 10 so that the pressure pulsation reducing mechanism 9 reduces the spread of the pressure pulsation generated in the high-pressure pump to a fuel pipe 28. When the fuel sucked in the pressurizing chamber 11 is returned through the opened inlet valve body 301 to the intake path 10*b* (the intake port 30*a*) under a state in which the flow rate of the fuel is controlled, the fuel returned to the intake path 10*b* (the intake port 30*a*) generates the pressure pulsation in the low-pressure fuel chamber 10. However, the pressure pulsation is absorbed and reduced by the expansion and contraction of a metal damper 9*a* forming the pressure pulsation reducing mechanism 9 provided to the low-pressure fuel chamber 10. The metal damper 9*a* is formed of two corrugated metal disks of which outer peripheries are bonded together. Inert gas such as argon is injected in the metal damper 9*a*. Mounting hardware 9*b* is configured to fix the metal damper 9*a* on the inner periphery of the pump body 1.

The electromagnetic inlet valve 30 is a variable control mechanism that includes the electromagnetic coil 308. The electromagnetic inlet valve 30 is connected to the ECU through the terminal 307 and repeats conduction and non-conduction of electricity so as to open and close the inlet valve and control the flow rate of the fuel.

When the electromagnetic coil 308 does not conduct electricity, the biasing force of the anchor spring 303 is transmitted to the inlet valve body 301 through the anchor 305 and the anchor rod 302 integrally formed with the anchor 305. The biasing force of the valve spring 304 installed in the inlet valve body is set so that the biasing force of the anchor spring 303>the biasing force of the valve spring 304 holds. As a result, the inlet valve body 301 is biased in a valve-opening direction in which the inlet valve body 301 is opened. The intake opening 30*d* is opened. Meanwhile, the anchor rod 302 has contact with the inlet valve body 301 at a part 302*b* (in a state illustrated FIG. 1).

The setting for the magnetic biasing force generated by the electricity conduction through the coil 308 is configured to enable the anchor 305 to overcome the biasing force of the anchor spring 303 and be sucked into a stator 306. When the coil 308 conducts electricity, the anchor 303 moves toward the stator 306 (the left side of the drawing) and a stopper 302*a* formed on an end of the anchor rod 302 has contact with an anchor rod bearing 309 and is seized. At that time, the clearance is set so that the travel distance of the anchor 301>the travel distance of the inlet valve body 301 holds. The contact part 302*b* opens between the anchor rod 302 and the inlet valve body 301. As a result, the inlet valve body 301 is biased by the valve spring 304 and the intake opening 30*d* is closed.

The electromagnetic inlet valve 30 is fixed to the pump body 1 while an inlet valve seat 310 is hermetically inserted in a tubular boss 1*b* so that the inlet valve body 301 can seal the intake opening 30*d* to the pressurizing chamber. When the electromagnetic inlet valve 30 is attached to the pump body 1, the intake port 30*a* is connected to the intake path 10*b*.

The discharge valve mechanism 8 is provided with a plurality of discharge paths radially drilled around the sliding axis of the discharge valve body 8*b*. The discharge valve mechanism 8 includes a discharge valve seat member 8*a* and a discharge valve member 8*b*. The discharge valve seat member 8*a* is provided with a bearing that can sustain the sliding reciprocation of the discharge valve body 8*b* at the center of the discharge valve seat member 8*a*. The discharge valve member 8*b* has the central axis so as to slide with respect to the bearing of the discharge valve seat member 8*a*, and has a circular contact surface on the outer periphery. The circular contact surface can retain the airtightness by having contact with the discharge valve seat member 8*a*. Furthermore, a discharge valve spring 33 is inserted and held in the discharge valve mechanism 8. The discharge valve spring 33 is a coil spring that biases the discharge valve member 8*b* in a valve-closing direction in which the discharge valve member 8*b* is closed. The discharge valve seat member, for example, is pressed, inserted and held in the pump body 1. The discharge valve member 8*b* and the discharge valve spring 33 are further inserted in the pump body 1. A sealing plug 17 seals the pump body 1. This forms the discharge valve mechanism 8. The discharge valve mechanism 8 is formed as described above. The formation causes the discharge valve mechanism 8 to function as a check valve that controls the direction in which the fuel flows.

The operation of the pressure relief valve mechanism will be described in detail. As illustrated, a pressure relief valve mechanism 100 includes a pressure relief valve housing 101, a relief spring 102, a relief holder 103, a pressure relief valve 104, and a pressure relief valve seat 105. After the pressure relief valve seat 105 is pressed, inserted and fixed to the pressure relief valve housing 101, the pressure relief valve 104, the relief holder 103, and the relief spring 102 are sequentially inserted. The set load of the relief spring 102 is determined depending on the position at which the pressure relief valve seat is fixed. The valve-opening pressure at which the pressure relief valve 104 is opened is determined depending on the set load of the relief spring 102. The pressure relief valve mechanism 100 unitized as described above is fixed to the pump body 1 by the press-insertion of the pressure relief valve seat 105 to the inner peripheral wall of a cylindrical pass-through slot 1C provided to the pump body 1. Subsequently, the discharge joint 12 is fixed so that the discharge joint 12 blocks the cylindrical pass-through slot 1C of the pump body 1 so as to prevent the fuel from leaking from the high-pressure pump to the outside and to enable the pressure relief valve mechanism 100 to be connected to a common rail. Meanwhile, the pressure relief valve mechanism 100 is partially stored in the discharge joint 12.

The discharge valve mechanism 8 and the pressure relief valve mechanism 100 are installed in the pump body so that the central axes of the discharge valve mechanism 8 and the pressure relief valve mechanism 100 are radially arranged around the pressurizing chamber 11. This can make the process easy while the pump body 1 is produced.

Figure 5:
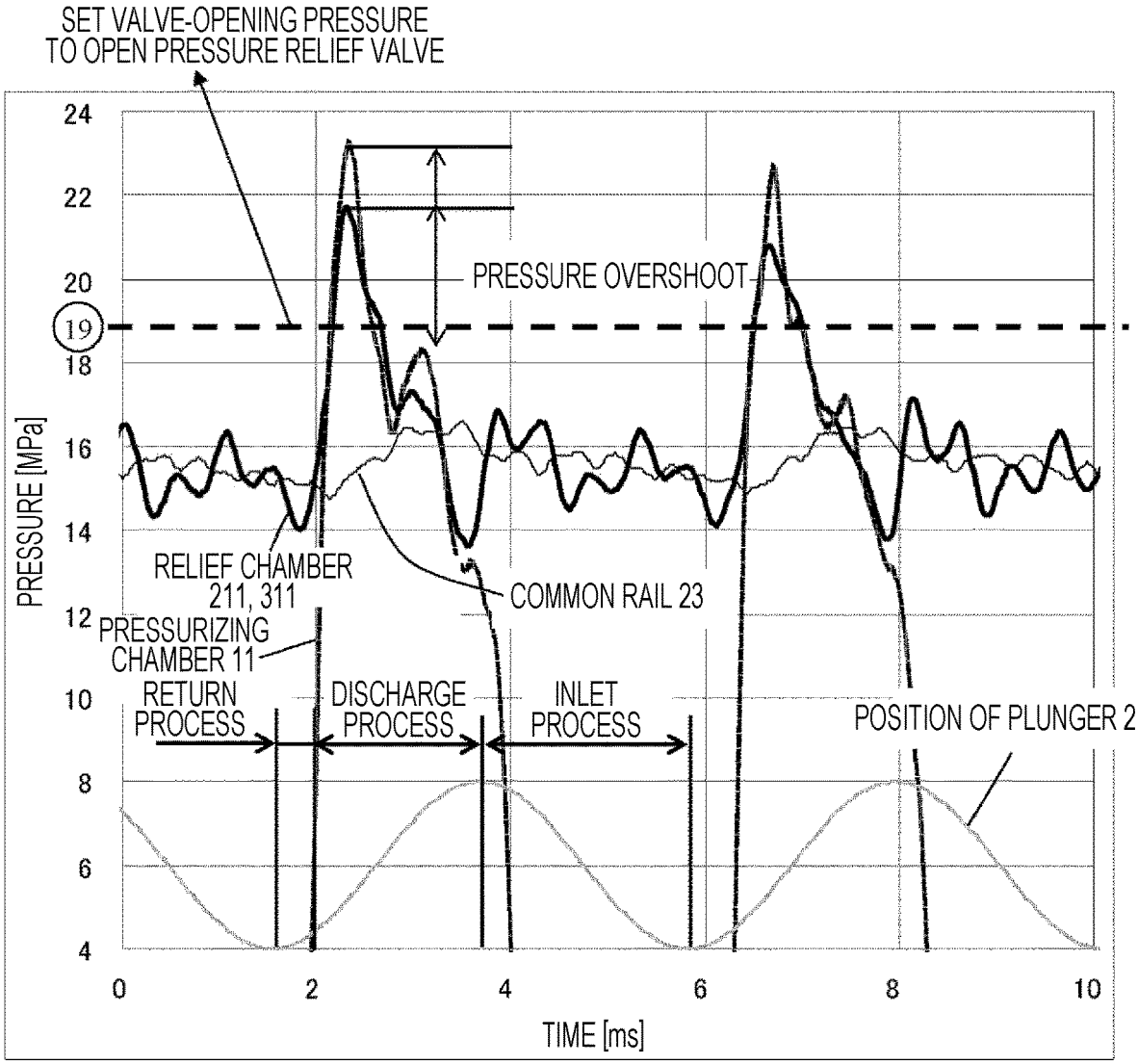
FIG. 5 illustrates the pressure waveforms in each part and a common rail of the high-pressure fuel supply pump according to the first embodiment of the present invention.

The overshoot generated in the pressurizing chamber will be described with reference to FIG. 5. When the motion of the plunger 2 starts decreasing the volume of the pressurizing chamber 11, the pressure in the pressurizing chamber increases with the decrease in volume. When the pressure in the pressurizing chamber finally exceeds the pressure in the discharge flow path 110, the discharge valve mechanism 8 is opened and the fuel is discharged from the pressurizing chamber 11 to the discharge flow path 110. From the moment the discharge valve mechanism 8 is opened to the time immediately after the opening, the pressure in the pressurizing chamber overshoots and becomes very high. The very high pressure propagates in the discharge flow path and the pressure in the discharge flow path simultaneously overshoots. If the outlet of the pressure relief valve mechanism 100 is connected to the intake flow pass 10*b* at the overshoot, the overshoot of the pressure in the discharge flow path causes the pressure difference between the inlet and outlet of the pressure relief valve 104 to exceed the valve-opining pressure at which the pressure relief valve mechanism 100 is opened. This causes an error in the pressure relief valve. In light of the foregoing, the outlet of the pressure relief valve mechanism 100 of the embodiment is connected to the pressurizing chamber 11, and thus the pressure in the pressurizing chamber acts on the outlet of the pressure relief valve mechanism 100 and the pressure in the discharge flow path 110 acts on the inlet of the pressure relief valve mechanism 11. The pressure overshoot occurs simultaneously in the pressurizing chamber and the discharge flow path. Thus, the pressures difference between the inlet and outlet of the pressure relief valve does not exceed the valve-opining pressure at which the pressure relief valve is opened. In other words, an error in the pressure relief valve does not occur.

When the motion of the plunger 2 starts increasing the volume of the pressurizing chamber 11, the pressure in the pressurizing chamber decreases with the increase in volume. When the pressure in the pressurizing chamber falls below the pressure in the intake path 10*b* (the intake port 30*a*), the fuel flows from the intake path 10*b* (the intake port 30*a*) into the pressurizing chamber 11. When the motion of the plunger 2 starts decreasing the volume of the pressurizing chamber 11 again, the fuel is pressurized at high pressure and discharged due to the mechanism described above.

Next, an example in which failure of the direct-injection injector 24 generates an excessive high pressure in the common rail 23 will be described in detail.

In the event of failure of the direct-injection injector, in other words, when the injection function of the direct-injection injector stops and the direct-injection injector does not feed the fuel fed in the common rail 23 into the combustion chamber of the internal-combustion engine, the fuel accumulates between the discharge valve mechanism 8 and the common rail 23. This causes an excessive high pressure of the fuel. When the fuel pressure moderately increases to the excessive high pressure, the pressure sensor 26 provided to the common rail 23 detects the abnormal pressure. Then, the electromagnetic inlet valve 30 that is a flow rate control mechanism provided in the intake path the intake path 10*b* (the intake port 30*a*) is controlled by feedback control. The feedback control operates as a safety function to decrease the amount of the fuel to be discharged. However, the feedback control with the pressure sensor is not effective in dealing with an instantaneous excessive high pressure. When the electromagnetic inlet valve 30 is out of order and keeps the maximum flow rate in an operation state in which the fuel is not required so much, the pressure at which the fuel is discharged excessively increases. In such a case, the excessive high pressure is not dissolved because of the failure of the flow rate control mechanism even when the pressure sensor 26 of the common rail 23 detects the excessive high pressure.

When the excessive high pressure described above occurs, the pressure relief valve mechanism 100 of the embodiment functions as a safety valve.

When the motion of the plunger 2 starts increasing the volume of the pressurizing chamber 11, the pressure in the pressurizing chamber decreases with the increase in volume. When the pressure in the inlet of the pressure relief valve mechanism 100, namely, in the discharge flow path is higher than or equal to the pressure in the outlet of the pressure relief valve, namely, in the pressurizing chamber 11 by the valve-opening pressure at which the pressure relief valve mechanism 100 is opened, the pressure relief valve mechanism 100 is opened and returns the fuel at an excessive high pressure in the common rail to the pressurizing chamber. This return prevents the fuel pressure from being higher than or equal to a predetermined pressure even when an excessive high pressure occurs. This prevention protects the high-pressure pipe system including the common rail 23.

In the present embodiment, the mechanism described above prevents the pressure difference between the inlet and outlet of the pressure relief valve mechanism 100 from being higher than or equal to the valve-opening pressure at which the pressure relief valve mechanism 100 is opened, and thus, the pressure relief valve mechanism 100 is not opened in the discharge process.

In the intake process and the return process, the fuel pressure in the pressurizing chamber 11 decreases to a low pressure identical to the pressure in the intake pipe 28. On the other hand, the pressure in the relief chamber 112 increases to a pressure identical to the pressure in the common rail 23. When the differential pressure between the relief chamber 112 and the pressurizing chamber is higher than or equal to the valve-opening pressure at which the pressure relief valve 104 is opened, the pressure relief valve 104 is opened and the fuel at an excessive high pressure is returned from the relief chamber 112 to the pressurizing chamber 11. This protects the high-pressure pipe system including the common rail 23.

Second Embodiment

Figure 6:
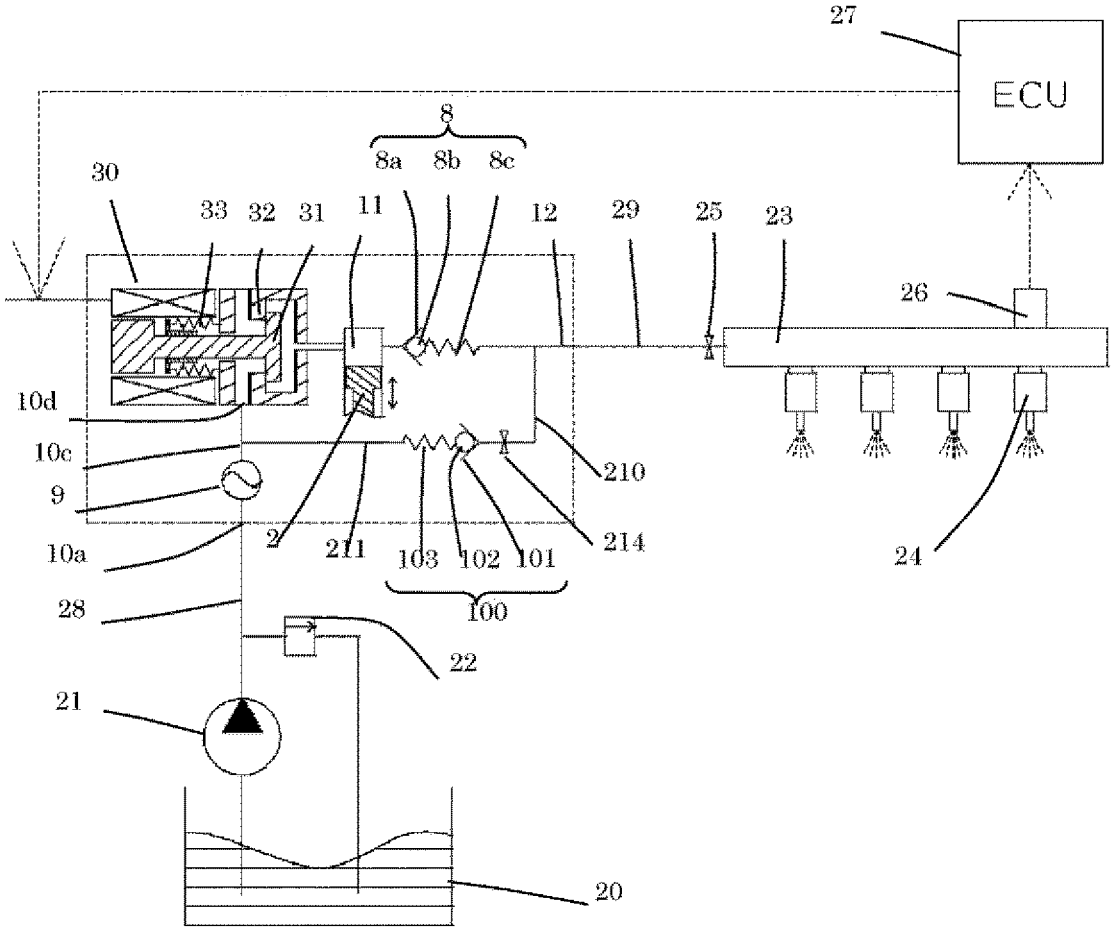
FIG. 6 illustrates an exemplary fuel supply system using the high-pressure fuel supply pump according to a second embodiment of the present invention.
Figure 7:
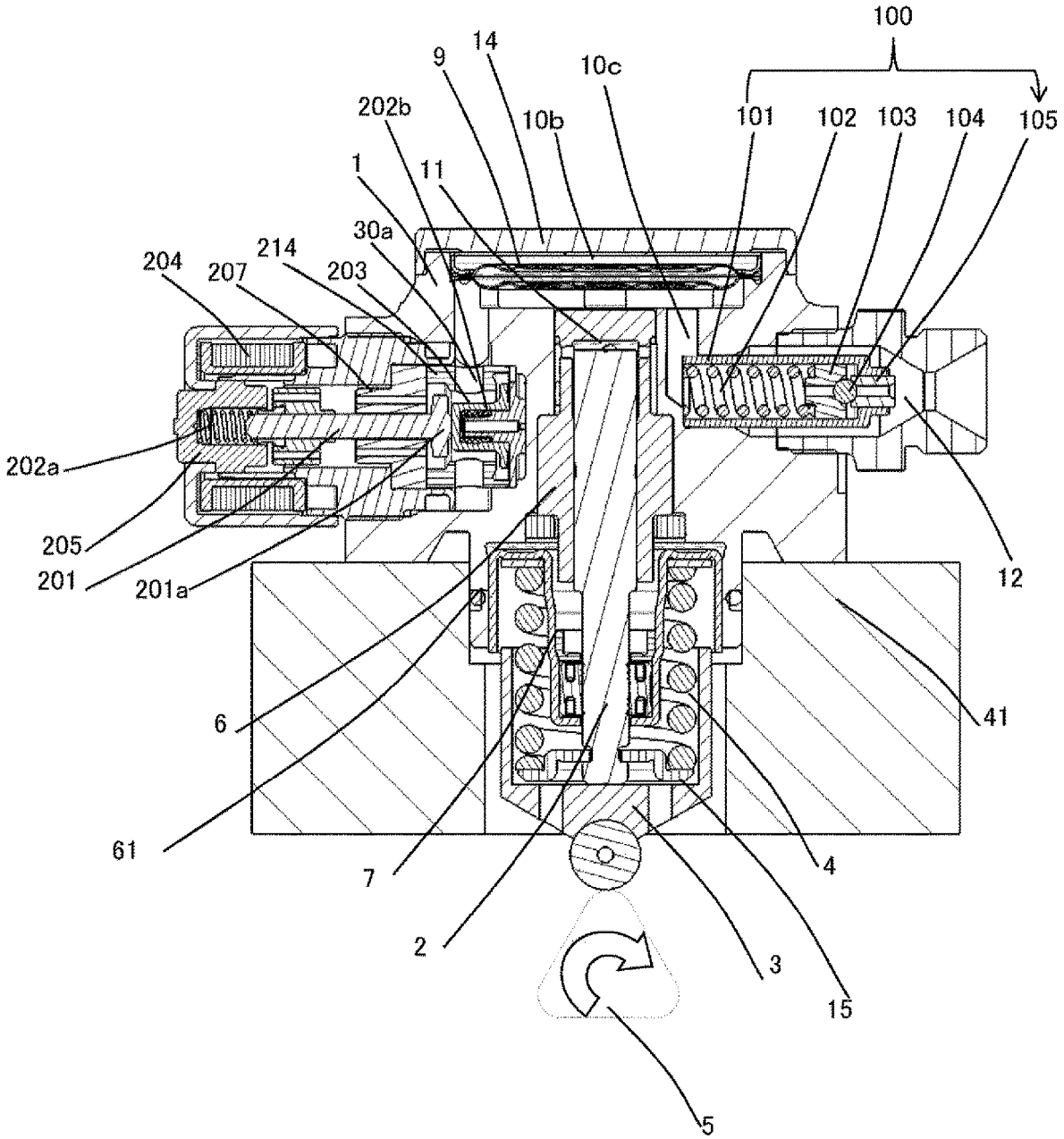
FIG. 7 is a vertical cross-sectional view of the whole of the high-pressure fuel supply pump according to the second embodiment of the present invention.

Next, a second embodiment will be described with reference to FIGS. 6 and 7.

In the second embodiment, a pressure relief valve mechanism 100 provided to a pump body 1 communicates the downstream part of a discharge valve 8*b* with an intake path 10*b*. A pressure relief valve 104 is pressed to a pressure relief valve seat 105 by a relief spring 102 generating pressing force. When the pressure difference between the intake path and a relief path is higher than or equal to a predetermined pressure, the pressure relief valve 104 moves away from the pressure relief valve seat 105 and opens.

When, for example, failure of a direct-injection injector 24 generates an excessive high pressure, for example, in a common rail 23 and the differential pressure between the discharge flow path 110 and the intake path 10*b* is higher than or equal to the valve-opening pressure at which the pressure relief valve 104 is opened, the pressure relief valve 104 is opened and the discharge flow path at the excessive high pressure is returned from the discharge flow path 110 to the pressurizing chamber 11. This protects the high-pressure pipe system including the common rail 23.

Third Embodiment

Figure 8:
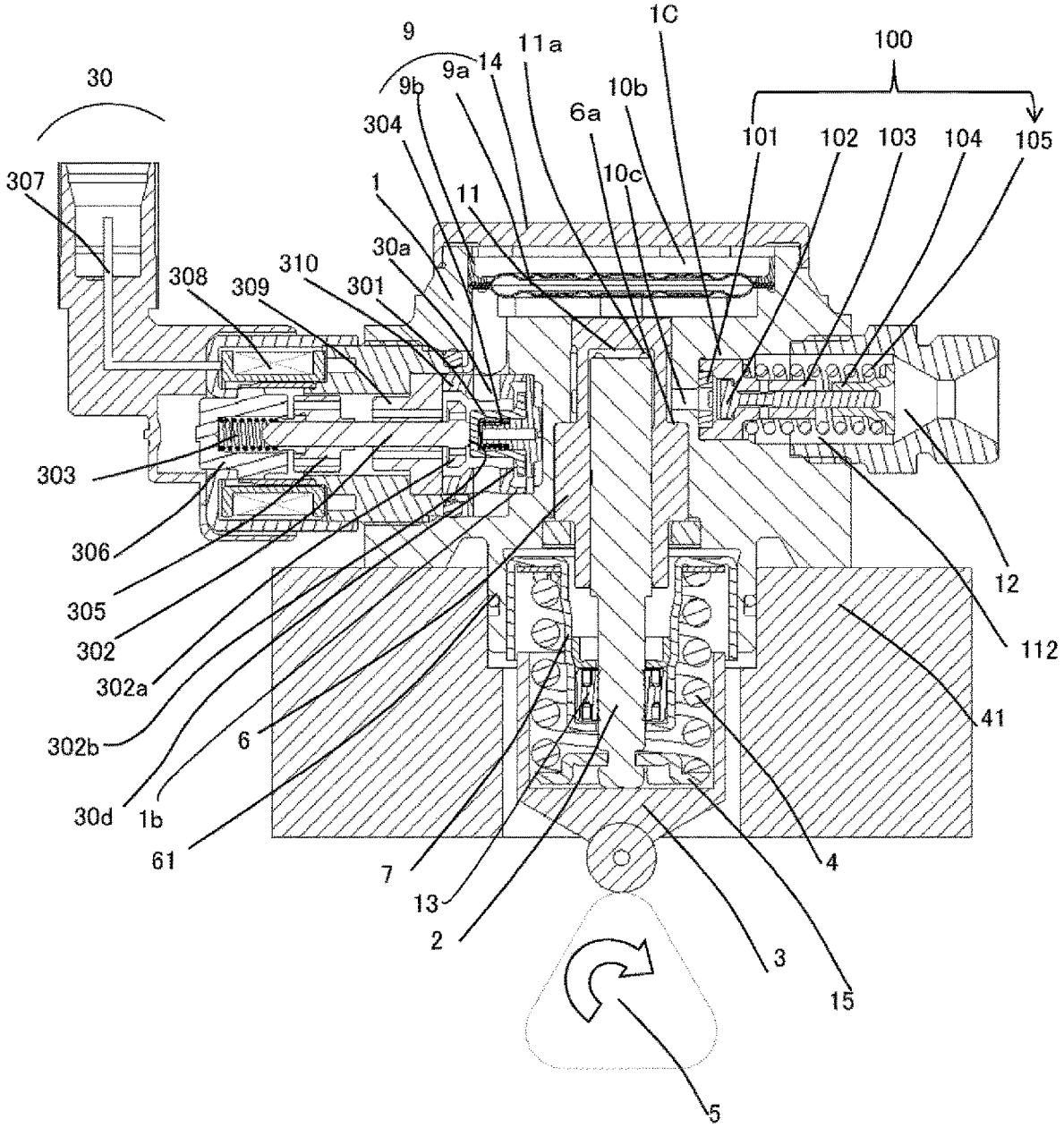
FIG. 8 is a vertical cross-sectional view of the whole of a high-pressure fuel supply pump according to a third embodiment of the present invention.

Next, a third embodiment will be described with reference to FIGS. 8 and 9.

In the third embodiment, a pressure relief valve mechanism 100 includes a pressure relief valve stopper 101, a pressure relief valve 102, a pressure relief valve seat 103, a relief spring stopper 104, and a relief spring 105 as illustrated. The pressure relief valve seat 103 includes a bearing that enables the pressure relief valve 102 to slide. The pressure relief valve 102 integrally including a sliding shaft is inserted in the pressure relief valve seat 103. After that the position of the relief spring stopper 104 is determined so that the relief spring 105 has a desired load, and the relief spring stopper 104 is fixed to the pressure relief valve 102, for example, by press and insertion. The valve-opening pressure at which the pressure relief valve 102 is opened is determined depending on the pressing force of the relief spring 105. The pressure relief valve stopper 101 is inserted between the pump body 1 and the pressure relief valve seat 103 so as to function as a stopper that controls how much the pressure relief valve 102 is opened. The pressure relief valve mechanism 100 unitized as described above is fixed to the pump body 1 by the press and insertion of the pressure relief valve seat 103 to the inner peripheral wall of a cylindrical pass-through slot 1C provided to the pump body 1. In other words, the pressure relief valve is an inward-opening valve. The relief spring 105 is provided on a side of the pressure relief valve 102 facing the discharge joint 12 as described above. This prevents the increase in volume of the pressurizing chamber 11 even when the outlet of the pressure relief valve 104 of the pressure relief valve mechanism 100 is opened toward the pressurizing chamber 11.

REFERENCE SIGNS LIST

1 pump body
2 plunger
6 cylinder
8 discharge valve mechanism
9 pressure pulsation reducing mechanism
11 pressurizing chamber
30 electromagnetic inlet valve
100 pressure relief valve mechanism
101 pressure relief valve housing
102 relief spring
103 relief holder
104 pressure relief valve
105 pressure relief valve seat

The invention claimed is:

1. A high-pressure fuel pump comprising:
first and second valve chests formed in a pump body;
a discharge valve placed in the first valve chest;
a pressure relief valve mechanism including a pressure relief valve placed in the second valve chest;
springs that bias the discharge valve and the pressure relief valve toward valve seats, respectively; and
a discharge joint that partially stores the pressure relief valve mechanism, is connected to a high-pressure pipe, and discharges the fuel to the high-pressure pipe when the discharge valve is open
a path communicates with an outlet side of the discharge joint and a discharge path formed in the pump body,
the pressure relief valve mechanism includes a relief valve housing storing the pressure relief valve and at least one of the springs, and
the path is defined by an outer surface of the relief valve housing and an inner surface of the discharge joint.

2. The high-pressure pump according to claim 1, further comprising:
a plug that seals the first valve chest in which the discharge valve and the spring biasing the discharge valve are stored.

3. The high-pressure pump according to claim 2, wherein
the relief valve mechanism is fixed to the pump body in non-contact with the discharge joint.

4. The high-pressure pump according to claim 1, wherein a central axis of the discharge valve and a central axis of the pressure relief valve are radially arranged around a pressurizing chamber.

5. The high-pressure pump according to claim 1, wherein the pressure relief valve opens toward a side of the high pressure fuel pump.

6. A high-pressure fuel pump comprising:

first and second valve chests formed in a pump body;

a discharge valve placed in the first valve chest;

a pressure relief valve mechanism including a pressure relief valve placed in the second valve chest;

springs that bias the discharge valve and the pressure relief valve toward valve seats, respectively;

a discharge joint that partially stores the pressure relief valve mechanism, is connected to a high-pressure pipe, and discharges the fuel to the high-pressure pipe when the discharge valve is open; and a plug that seals the first valve chest in which the discharge valve and the spring biasing the discharge valve are stored, wherein the spring biasing the pressure relief valve has a first distal end that directly contacts the pump body and a second distal end that directly contacts a relief holder of the pressure relief valve.

7. The high-pressure pump according to claim 6, further comprising:

a first discharge path formed in a pump housing, the first discharge path being configured to connect a high-pressure path of a downstream part of the discharge valve to a second discharge path formed between an outer surface of the pressure relief valve mechanism and an inner surface of the discharge joint.

8. The high-pressure pump according to claim 6, wherein a central axis of the discharge valve and a central axis of the pressure relief valve are radially arranged around a pressurizing chamber.

9. The high-pressure pump according to claim 6, wherein the pressure relief valve opens toward a side the pressure fuel pump.

10. A high-pressure fuel pump comprising:

first and second valve chests formed in a pump body;

a discharge valve mechanism including a discharge valve placed in the first valve chest;

a pressure relief valve mechanism including a pressure relief valve placed in the second valve chest;

springs that bias the discharge valve and the pressure relief valve toward valve seats, respectively; and— a discharge joint that partially stores the pressure relief valve mechanism, is connected to a high-pressure pipe, and discharges the fuel to the high-pressure pipe when the discharge valve is open, a plug that seals the first valve chest in which the discharge valve and the spring biasing the discharge valve are stored, wherein the pressure relief valve has a protruding portion that protrudes toward an outer peripheral side with respect to the pump body, and the discharge joint houses the protruding portion, and a path formed in the pump body communicates between an outlet of the discharge valve and an outer surface of the protruding portion.

11. The high-pressure pump according to claim 10, further comprising:

a first discharge path formed in a pump housing, the first discharge path being configured to connect a high-pressure path of a downstream part of the discharge valve to a second discharge path formed between an outer surface of the pressure relief valve mechanism and an inner surface of the discharge joint.

12. The high-pressure pump according to claim 10, wherein a central axis of the discharge valve and a central axis of the pressure relief valve are radially arranged around a pressurizing chamber.

13. The high-pressure pump according to claim 10, wherein the pressure relief valve opens toward a side the pressure fuel pump.

14. The high-pressure pump according to claim 10, further comprising: an electromagnetic plunger; and an inlet valve body with which the tip of the electromagnetic plunger contact seals an intake opening connected to a pressurizing chamber.

* * * * *